US010039355B2

(12) United States Patent
Brouillard

(10) Patent No.: US 10,039,355 B2
(45) Date of Patent: Aug. 7, 2018

(54) STORAGE CONTAINER

(71) Applicant: Richard R. Brouillard, North Dartmouth, MA (US)

(72) Inventor: Richard R. Brouillard, North Dartmouth, MA (US)

( * ) Notice: Subject to any disclaimer, the term of this patent is extended or adjusted under 35 U.S.C. 154(b) by 0 days.

(21) Appl. No.: 14/587,609

(22) Filed: Dec. 31, 2014

(65) Prior Publication Data

US 2016/0185492 A1 Jun. 30, 2016

(51) Int. Cl.

| | |
|---|---|
| ***A45C 5/04*** | (2006.01) |
| ***B65D 43/16*** | (2006.01) |
| ***A45C 13/00*** | (2006.01) |
| ***A45C 13/04*** | (2006.01) |
| *A45C 13/36* | (2006.01) |
| *B65D 6/02* | (2006.01) |

(52) U.S. Cl.

CPC ..... *A45C 5/04* (2013.01); *A45C 13/005* (2013.01); *A45C 13/04* (2013.01); *B65D 9/06* (2013.01)

(58) Field of Classification Search

CPC ..... B65D 43/166; B65D 43/167; B65D 2543/00351; A45C 5/04; A45C 13/005; A45C 13/04; A45C 9/06

USPC .... 217/17, 69; 220/810, 841, 843, 844, 848, 220/845; 190/35, 25

See application file for complete search history.

(56) References Cited

U.S. PATENT DOCUMENTS

| | | | | | |
|---|---|---|---|---|---|
| 248,486 | A * | 10/1881 | McGuire | A45C 5/02 | 190/28 |
| 273,175 | A * | 2/1883 | Simon | A45C 13/36 | 190/37 |
| 433,389 | A * | 7/1890 | Andrews | A45C 13/36 | 190/37 |
| 571,152 | A * | 11/1896 | Crouch | A45C 5/02 | 190/28 |
| 1,115,233 | A * | 10/1914 | Morgan | B65D 9/14 | 217/15 |
| 1,619,561 | A * | 3/1927 | Bolz | A45C 5/04 | 190/28 |
| 1,720,158 | A * | 7/1929 | Wheary | A45C 5/065 | 190/13 R |
| 4,360,953 | A * | 11/1982 | Angermann | A61G 17/00 | 27/14 |
| 4,744,445 | A * | 5/1988 | Anderson | A45C 5/02 | 190/107 |
| 4,967,455 | A * | 11/1990 | Elder | A61G 17/0073 | 27/14 |

* cited by examiner

*Primary Examiner* — J. Gregory Pickett
*Assistant Examiner* — Niki M Eloshway
(74) *Attorney, Agent, or Firm* — Pandiscio & Pandiscio

(57) ABSTRACT

A storage container comprising a four-sided structure having a bottom panel and a pivotally mounted top panel. The container is provided with a lateral beam extending side-to-side across a back panel thereof. Hinge means are fixed to the back panel and extend along three surfaces of the lateral beam, and are fixed to the top panel, such that the top panel is pivotally mounted on the back panel and adapted to open and close with substantially simultaneous engagement on the four sides of the top panel with the four sides of the container.

5 Claims, 9 Drawing Sheets

STORAGE CONTAINER

BACKGROUND OF THE INVENTION

1. Field of the Invention

The invention relates to a container having four side panels, a bottom panel, and a top panel, the side panels including a front panel, a back panel and two end panels. A lateral beam is fixed on the back panel and extends parallel to the top edge of the back panel. Hinge means are fixed to the back panel and the lateral beam thereon, and to the top panel, such that the hinge means is fixed to the back panel on both edges of the lateral beam, and encloses a portion of the lateral beam. The hinge means facilitates pivotal movement of the top panel at a pivot point above the lateral beam and above an upper edge of the back panel.

2. Description of the Prior Art

Hinge means for trunks, and the like, are customarily mounted on a back panel of the trunk spaced from any lateral beam extending across the back of the trunk. That is, the hinge means are generally mounted between the top edge of the trunk back panel and on the back panel, or on any lateral beam mounted on the back panel. Such providing the hinge means between the back and the top member results in a relatively weak pivotal interconnection between top and back panels of storage trunks, which are often subject to rough handling in the course of loading and unloading the trunks.

SUMMARY OF THE INVENTION

In accordance with the invention presented herein, there is provided a storage container comprising a four-sided structure having a bottom panel and a pivotally mounted top panel. The container is provided with a lateral beam extending side-to-side across a back panel thereof. Hinge means are fixed to the back panel and extend adjacent to three surfaces of the back panel lateral beam, and are fixed to the top panel, such that the top panel is pivotally mounted on the back panel, by virtue of mounting on a side wall of the top panel and on the back panel lateral beam, and is adapted to open and close.

The above and other features of the invention, including various novel details of construction and combinations of parts, will now be more particularly described with reference to the accompanying drawings and pointed out in the claims. It will be understood that the particular device embodying the invention is shown by way of illustration only and not as a limitation of the invention. The principles and features of this invention may be employed in various and numerous embodiments without departing from the scope of the invention.

BRIEF DESCRIPTION OF THE DRAWINGS

Reference is made to the accompanying drawings in which is shown an illustrative embodiment of the invention, from which its novel features and advantages will be apparent.

In the drawings.

DESCRIPTION OF THE PREFERRED EMBODIMENT

Figure 1:
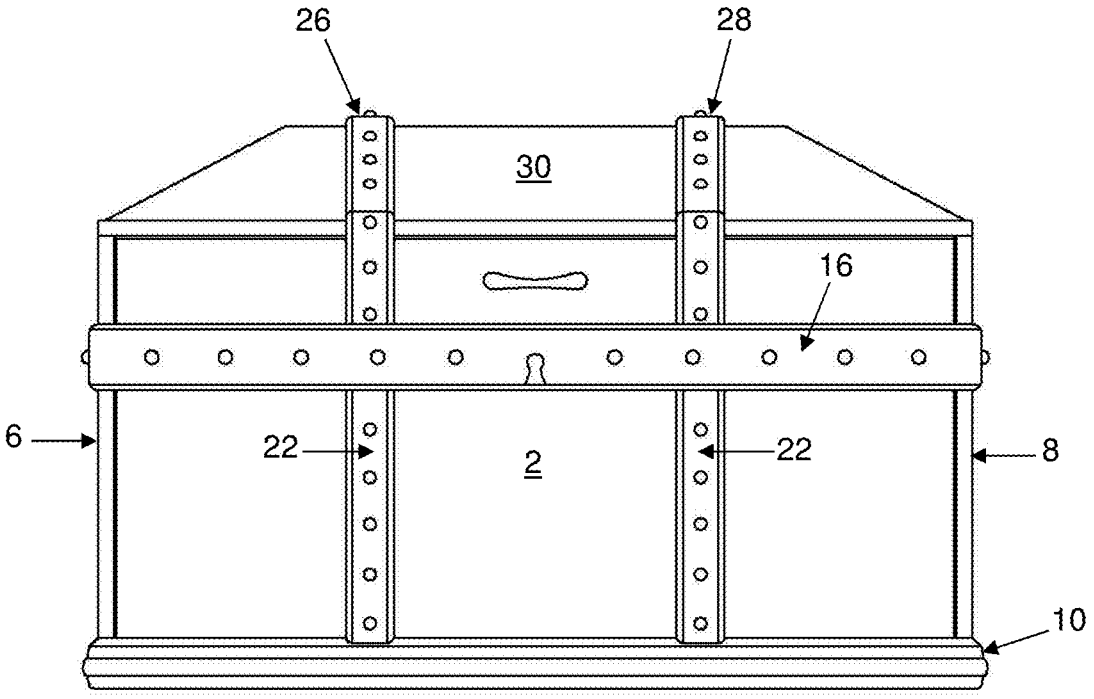
FIG. 1 is a front elevational view of one form of storage container assembly illustrative of an embodiment of the invention.
Figure 2:
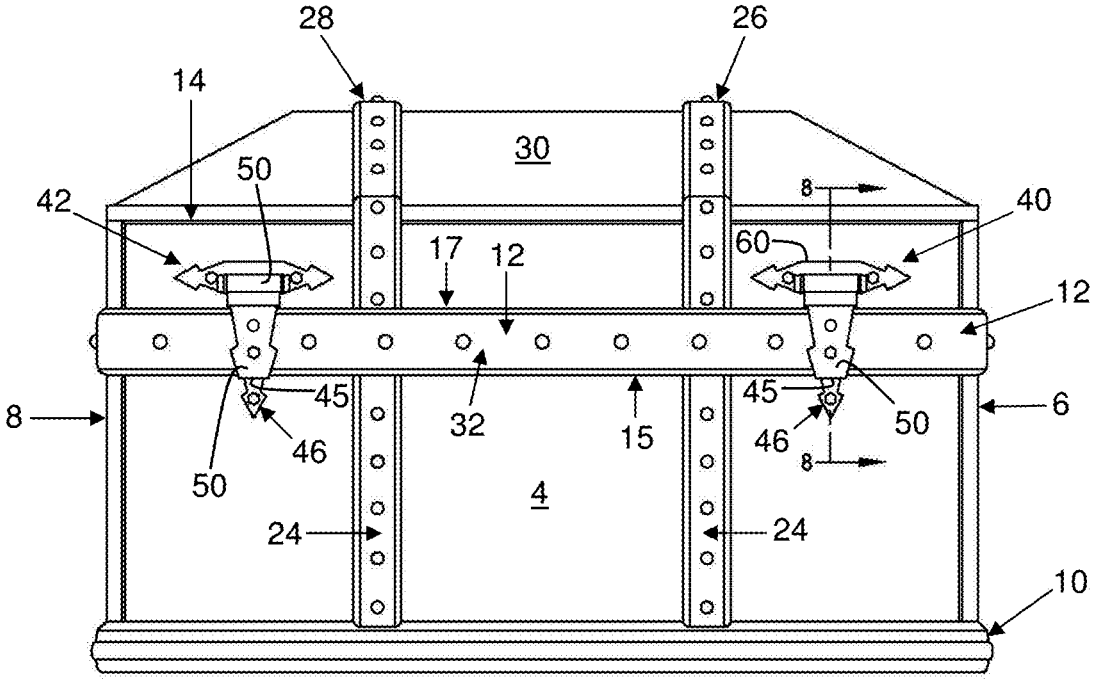
FIG. 2 is a rear elevational view thereof.
Figure 3:
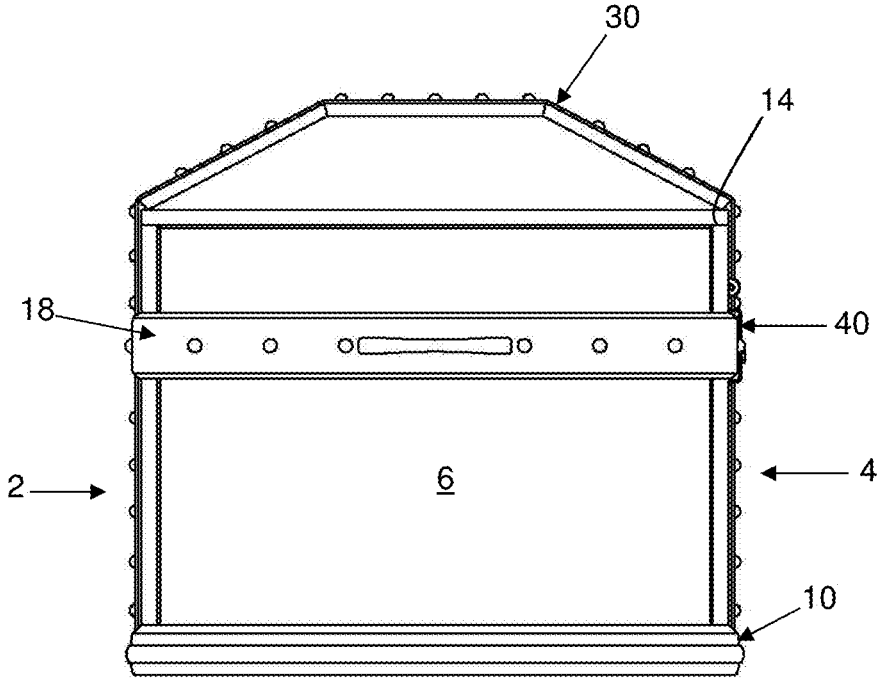
FIG. 3 is a first side elevational view thereof.
Figure 4:
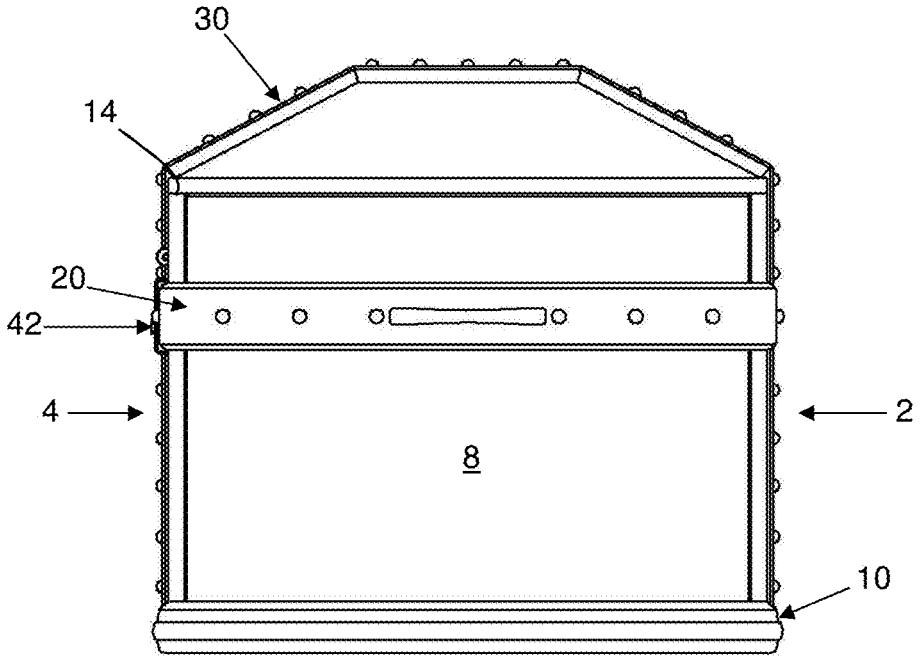
FIG. 4 is a second side elevational view thereof.
Figure 5:
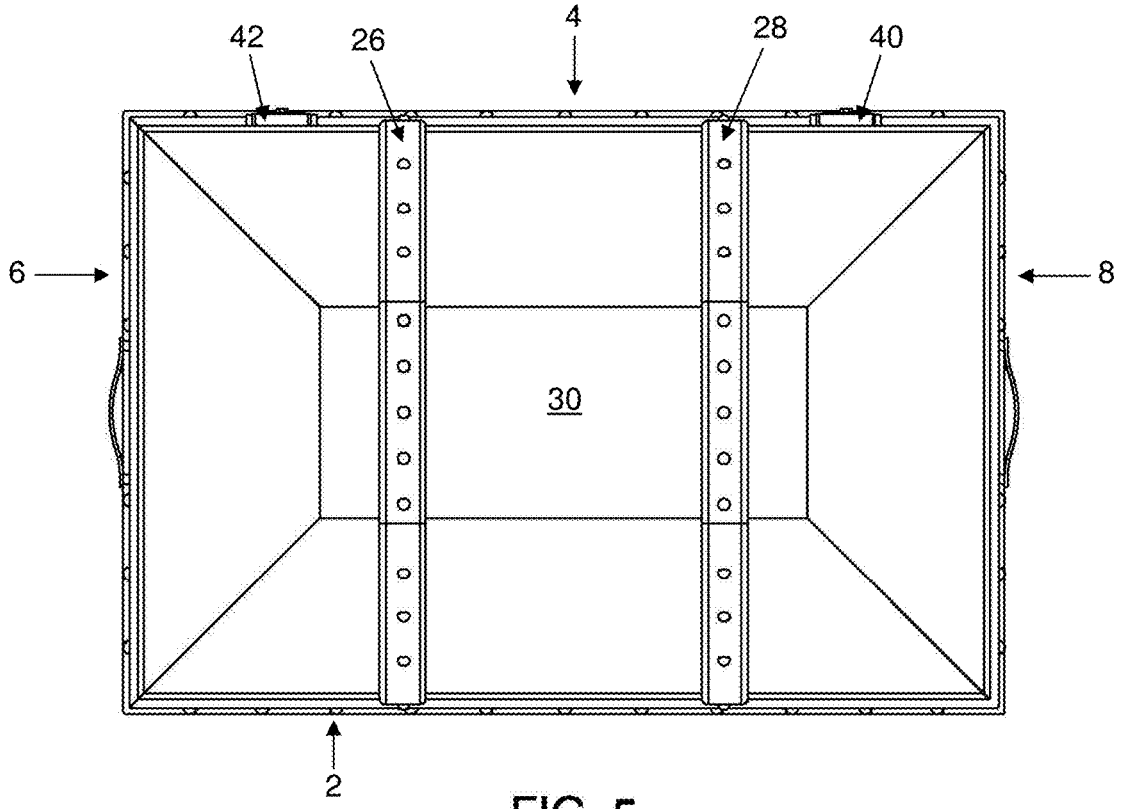
FIG. 5 is a top plan view thereof.

Referring to the drawings, particularly FIGS. 1-5, it will be seen that the storage container includes a front panel 2, a rear panel 4, and first and second end panels 6, 8, upstanding from a bottom panel 10.

A lateral beam 12 extends across the exterior of the rear panel 4, proximate and spaced from an upper edge 14 of the rear panel 4. Lateral beams 16, 18, 20 may be provided on the front and end panels 2, 6 and 8.

Similarly, vertical beams 22, 24 may be provided on the front and rear panels 2, 4, and front to rear top beams 26, 28 may be provided on a top section 30.

Figure 7:
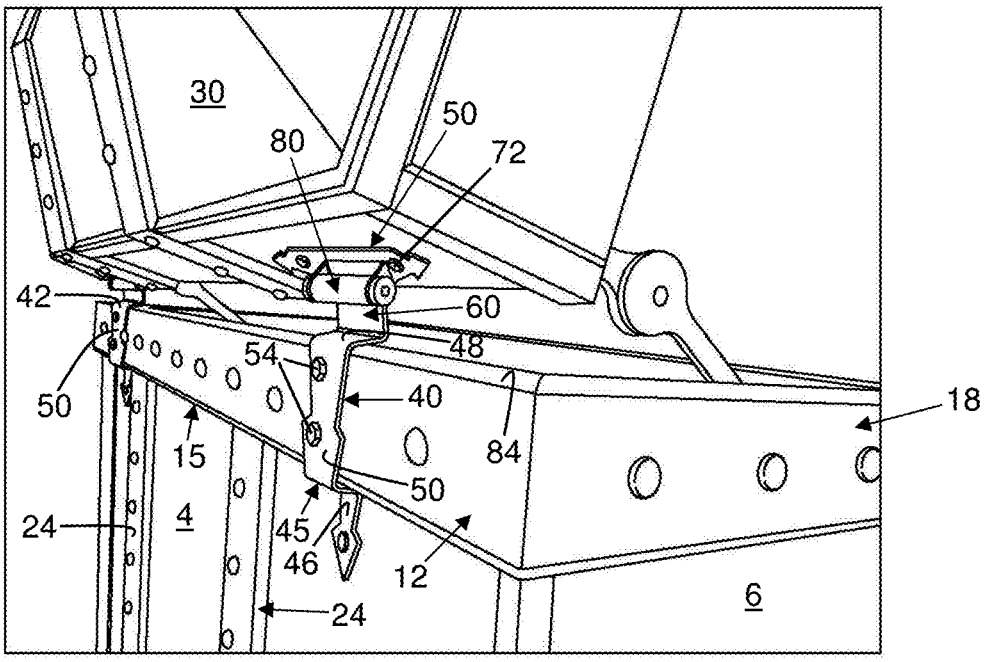
FIG. 7 is a perspective view of a hinge assembly portion of FIG. 6 showing a portion of a container back lateral beam, with the top of the container fully open.
Figure 8:
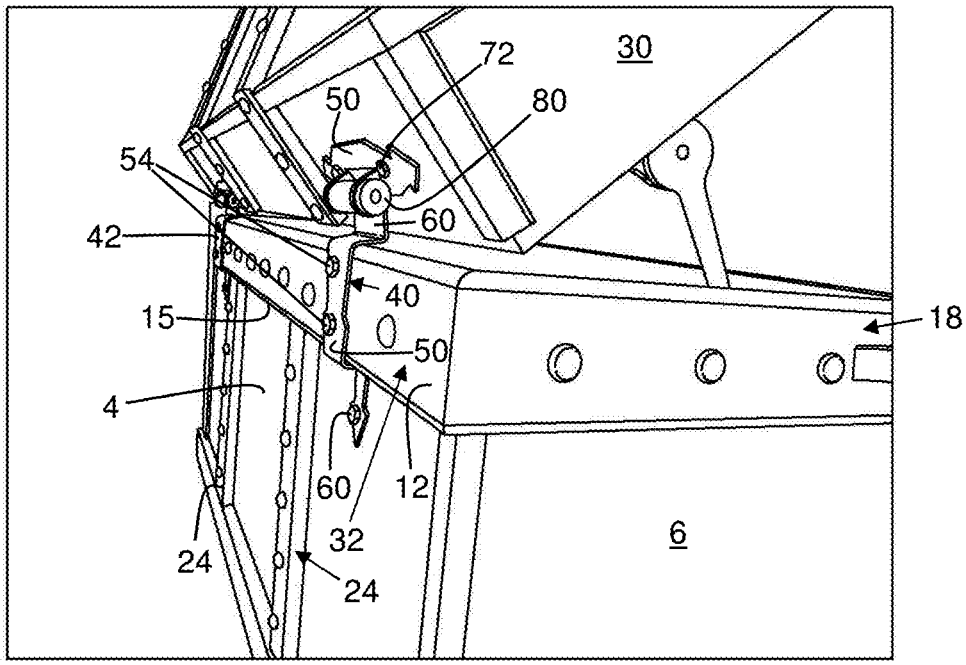
FIG. 8 is a perspective view of the hinge assembly shown in FIG. 7, with the top of the container about half open.
Figure 9:
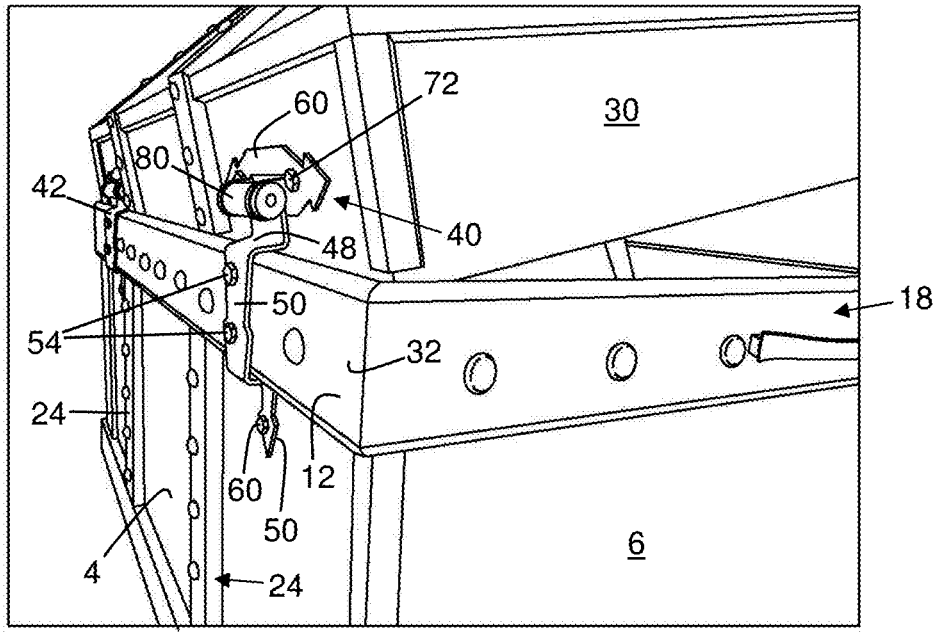
FIG. 9 is a perspective view of the hinge assembly of FIG. 8, wherein the top of the container is closer to closing.

Referring to FIGS. 7-9, it will be seen that hinge means 40, 42 interconnect the rear panel 4 and top panel 30.

Figure 6:
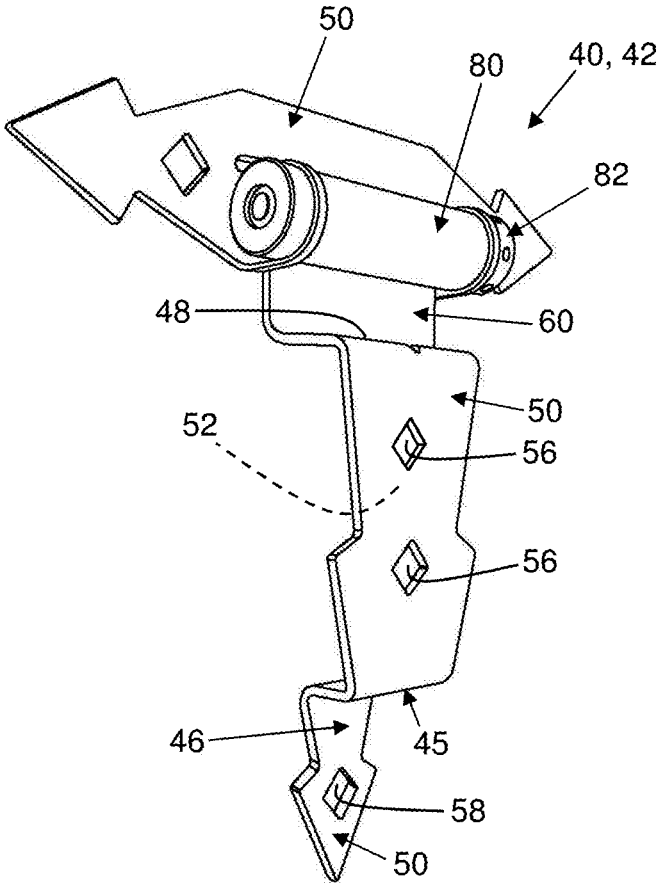
FIG. 6 is front perspective view of the hinge assembly portion of the container assembly.

Each of the hinge means 40, 42 comprises a rear plate 50 having an inner surface 52 (FIG. 6) fixed to an outer surface 32 of the rear lateral beam 12, as by fixture means 54 extending through openings 56, 58 (FIG. 6) in the plates 50, and into the rear lateral abeam 12.

The hinge means 40, 42 each comprise a planar lower surface 45 extending toward the rear panel 4 and adjacent to the lower edge 15 of the rear lateral beam 12, and a lower-most planner surface 46, extending from an inner edge of the surface 45. The lower-most planar surface 46 is provided with an opening 58 adapted to receive a fixture 60 for fixing the surface 46 to the rear panel 4.

Each hinge means 40, 42 further comprises a planar upper surface 48 extending toward the rear panel 4 and adjacent an upper edge 17 of the rear lateral beam 12.

Extending upwardly from the hinge surface 48 is a flange 60 having rotatably mounted thereon the plate 50 fixed to the top panel 30, as by fixtures 72, which may be wood screws, or the like.

In a preferred embodiment, the rotatable mounting between the plate 50 and the flange 60 comprises a rounded sleeve 80 mounted on the upper end of the flange 60 and having mounted thereon collar means 82 fixed to, and extending from, the flange 60.

The sleeve 80 is spaced upwardly from the rear panel upper edge 84, such that the lower edges of the top panel 30 all engage the upper edges of the lower panels 2, 4, 6 and 8 substantially simultaneously, such that excessive wear on a given panel is substantially avoided.

It is to be understood that the present invention is by no means limited to the particular construction herein disclosed and/or shown in the drawings, but also comprises any modification or equivalent within the scope of the claims.

What is claimed is:

1. A storage container comprising:

a rectangularly-shaped bottom panel;

a front panel, a rear panel, and two opposed end panels upstanding from the bottom panel;

a top panel having a front portion, a rear portion, and two opposed end wall portions adapted, respectively, to engage a portion of the front panel, rear panel, and end panels to close the volume defined by the bottom panel, front panel, rear panel and end panels;

a rear lateral beam mounted on the rear panel and extending parallel to an upper edge of the rear panel, the rear lateral beam having a top portion and a bottom portion;

a hinge for rotatably mounting the top panel to the rear panel, the hinge comprising a first mount and a second mount, the first mount and the second mount being movably connected by a pivot;

wherein the first mount comprises a planar portion, wherein the planar portion lies in a first plane;

wherein the second mount of the hinge comprises:

a first planar portion, a second planar portion and a third planar portion;

wherein the first planar portion is adjacent to the pivot, and wherein the second planar portion is disposed between the first planar portion and the third planar portion;

wherein the first planar portion and the third planar portion lie in a second plane, the second planar portion lies in a third plane, and wherein the third plane is laterally offset from the second plane;

wherein the second plane is laterally offset from the first plane so that a gap is created between the first planar portion of the second mount and the rear portion of the top panel when the first mount of the hinge is mounted to the rear portion of the top panel, the second planar portion of the second mount extends over the rear lateral beam, and the third planar portion of the second mount is mounted to the rear panel;

wherein the first mount of the hinge is fixed to the rear portion of the top panel by passing a fastener through a hole formed in the first mount of the hinge and into the rear portion of the top panel, the second planar portion of the second mount of the hinge is fixed to the rear lateral beam by passing a fastener through a hole formed in the second planar portion of the second mount of the hinge and into the rear lateral beam, and the third planar portion of the second mount of the hinge is fixed to the rear panel by passing a fastener through a hole formed in the third planar portion of the second mount of the hinge and into the rear panel.

2. The storage container in accordance with claim 1, wherein the front and end panels are provided with lateral beams in alignment with the rear lateral beam.

3. The storage contained in accordance with claim 2, wherein the lateral beams are provided with protrusions extending outwardly from outer surfaces of the lateral beams.

4. The storage container in accordance with claim 1, wherein the top panel is provided with a domed configuration.

5. A storage container comprising:

a generally planar front panel;

a generally planar rear panel;

the front and rear panels being substantially parallel to one another, each of the front and rear panels having first and second ends;

a first end panel extending substantially normal to the front and end rear panels, and a second end panel extending substantially normal to the front and rear panels, the end panels being substantially parallel to each other and interconnecting the front and rear panels;

a bottom panel fixed to the front panel, the rear panel, the first end panel and the second end panel; and a top panel hingedly connected to an upper surface of the rear panel and pivotally movable thereon between a raised position wherein the top panel is removed from the front panel, the rear panel, and the first and second end panels, and a closed position wherein underside surfaces of the top panel are engaged with top surfaces of the front and rear panels, and the first and second end panels;

a lateral beam fixed to the rear panel and extending from one of the first and second end panels to the other of the first and second end panels, and extending parallel to said rear panel upper and lower edges, the lateral beam having a top portion and a bottom portion;

two hinges spaced from one another and interconnecting said rear panel and said top panel, such that said top panel is adapted to close onto the top edge portions of said front, rear and end panels substantially simultaneously;

each of the two hinges comprising a first mount and a second mount, the first mount and the second mount being movably connected by a pivot;

wherein the first mount comprises a planar portion, wherein the planar portion lies in a first plane;

wherein the second mount of the hinge comprises:

a first planar portion, a second planar portion and a third planar portion;

wherein the first planar portion is adjacent to the pivot, and wherein the second planar portion is disposed between the first planar portion and the third planar portion;

wherein the first planar portion and the third planar portion lie in a second plane, the second planar portion lies in a third plane, and wherein the third plane is laterally offset from the second plane;

wherein the second plane is laterally offset from the first plane so that a gap is created between the first planar portion of the second mount and the top panel when the first mount of each of the hinges is mounted to the top panel, the second planar portion of the second mount of each of the hinges over the lateral beam, and the third planar portion of the second mount of each of the hinges is mounted to the rear panel;

wherein the first mount of each of the hinges is fixed to the top panel with a fastener extending through a hole formed in the first mount of each of the hinges and into the top panel, the second planar portion of the second mount of each of the hinges is fixed to the lateral beam with a fastener extending through a hole formed in the second planar portion of the second mount of each of the hinges and into the lateral beam, and the third planar portion of the second mount of each of the hinges is fixed to the rear panel with a fastener extending through a hole formed in the third planar portion of the second mount of each of the hinges and into the rear panel;

and further wherein rotation of the top panel on the pivot of each of the hinges causes pivotal movement of said top panel to substantially simultaneously engage top edges of said front, rear, first end panel and second end panel, to close said container.

* * * * *